United States Patent [19]

Murakami

[11] 4,023,162

[45] May 10, 1977

[54] ELECTRONIC BUZZER

[75] Inventor: Fumikazu Murakami, Chiba, Japan

[73] Assignee: Kabushiki Kaisha Daini Seikosha, Japan

[22] Filed: Sept. 11, 1975

[21] Appl. No.: 612,538

[30] Foreign Application Priority Data

| | | |
|---|---|---|
| Sept. 11, 1974 | Japan | 49-109344[U] |
| Sept. 11, 1974 | Japan | 49-109345[U] |
| Sept. 11, 1974 | Japan | 49-109352[U] |
| Sept. 17, 1974 | Japan | 49-112253[U] |

[52] U.S. Cl. ..... 340/384 E; 310/8.1

[51] Int. Cl.[2] ..... G08B 3/10

[58] Field of Search ..... 340/384 R, 384 E; 310/8.1, 8.2

[56] References Cited

UNITED STATES PATENTS

| | | | |
|---|---|---|---|
| 3,733,804 | 5/1973 | Diersbock | 340/384 E |
| 3,912,952 | 10/1975 | Kumon | 340/384 E |

*Primary Examiner*—Harold Pitts

*Attorney, Agent, or Firm*—Robert E. Burns; Emmanuel J. Lobato; Bruce L. Adams

[57] ABSTRACT

An electronic buzzer comprises an acoustic vibrator comprised of a circular metal plate having its entire periphery rigidly secured to a support, and a piezoelectric element adhered to one face of the metal plate. A driving circuit applies electric driving signals to the vibrator to vibrationally drive it at a 1/N multiple of its natural frequency, where N is an integer, so that the vibrator emits an audible buzzing sound. The metal plate is preferably mounted to undergo vibration in a natural vibration mode having only one nodal circle. The drive circuit includes an inductor connected in a closed loop with the vibrator, which functions as a capacitor, and the circuit applies signals at a selectively variable frequency to the closed loop to accordingly vary the inductance of the inductor to thereby vary the period of oscillation of the acoustic vibrator and the resultant frequency of the buzzing sound.

11 Claims, 15 Drawing Figures

FIG. 1
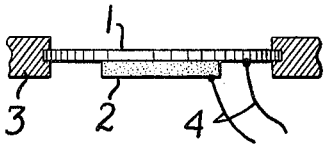
FIG. 2
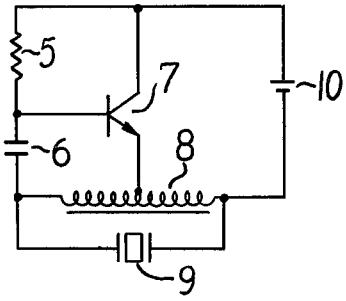
FIG. 3a
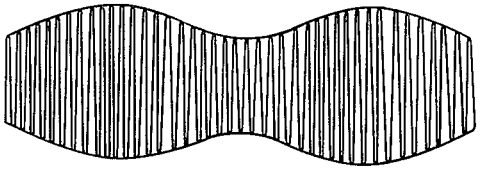
FIG. 3b
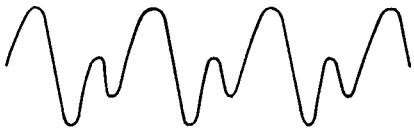
FIG. 4
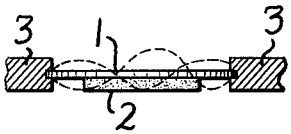
FIG. 3c
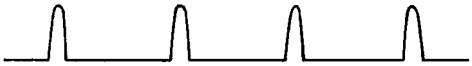
FIG. 5
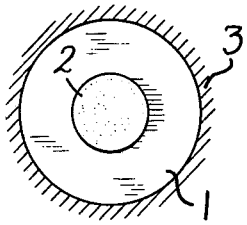
FIG. 3d
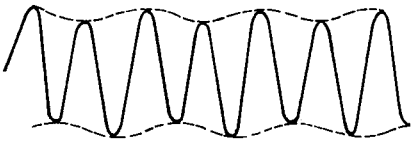
FIG. 7a
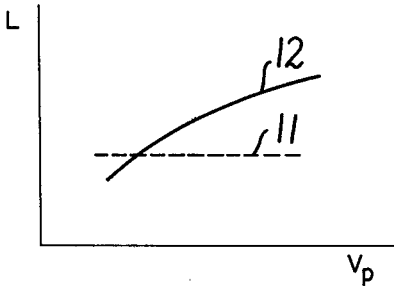
FIG. 3e
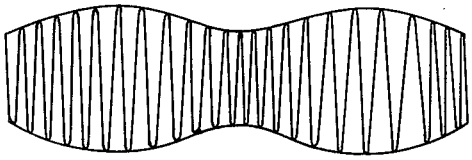
FIG. 6
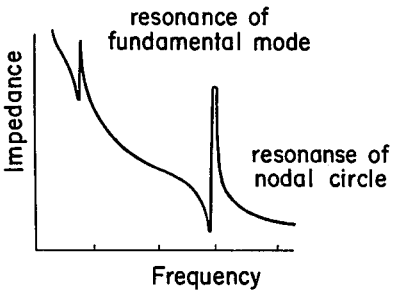
FIG. 7b
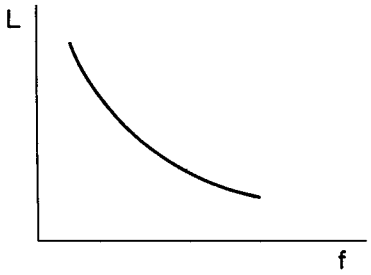
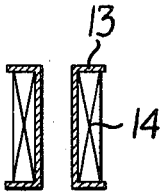
FIG. 8a
FIG. 8b
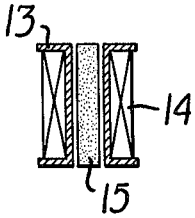
FIG. 7c
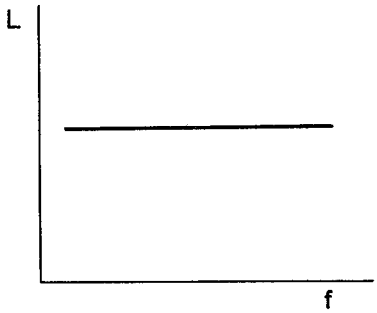

ELECTRONIC BUZZER

BACKGROUND OF THE INVENTION

1. FIELD OF THE INVENTION

This invention relates to an electronic buzzer with piezoelectric element and more particularly to an acoustic piezoelectric vibrator for producing a comfortable buzzing sound.

2. DESCRIPTION OF THE PRIOR ART

In conventional buzzer apparatus, an acoustic vibrator employing a piezoelectric element vibrates with its peripheral portion free and unsupported.

This type of vibrator is not effective to have a low quality factor Q and also needs a higher voltage power source to obtain the intensity of sound in comparison with a vibrator which has its peripheral portion fixed or supported.

In addition, most prior art electronic buzzers generate a monotonic buzzing sound and they would need complicated circuitry for providing a variation of tone.

The resonant frequency $fn$ of a circular vibrator whose peripheral portion fixed at a supporting member is maybe expressed by the following:

$$fn \alpha t/a^2$$

, where $t$ is the thickness of the vibrator and a is the radius of the vibrator.

SUMMARY OF THE INVENTION

The electronic buzzer of the invention comprises an acoustic vibrator composed of a metal plate and a piezoelectric element, and a driving circuit for vibrationally driving the vibrator.

The peripheral portion of the vibrator metal plate is secured to a supporting member and said piezoelectric element is attached to said metal plate.

The vibrator is driven by the driving circuit at one-integer multiples such as ½, ⅓ the natural frequency of the vibrator or at one-integer multiples, such as ½, ⅓ the frequency at which the vibrator oscillates with only one nodal circle.

It is therefore an object of this invention to provide an electronic buzzer employing a vibrator having its peripheral portion fixed by a supporting member and which operates with low dissipation of power.

It is another object of this invention to provide an electronic buzzer which is small in size being effective and producing a good buzzing sound and which has variation of intensity and frequency.

These and other objects and many of the attendant advantages of this invention will be more readily appreciated and the invention will be better understood by reference to the following detailed description when considered in connection with the accompanying drawing, in which:

FIG. 1 is a sectional view showing one embodiment of an acoustic vibrator,

FIG. 2 is an electric circuit embodying the invention,

FIG. 3*a* is a wave shape of the voltage across both terminals of a piezoelectric element 9 using a coil 8 having the characteristics of curve 11 as shown in FIG. 7*a*, FIG. 3*b*, 3*c* and 3*d* are diagrams, respectively, used to describe the operation when the vibrator is employed in the electric circuit shown in FIG. 2, FIG. 3*e* is a graphical wave shape of the voltage across both terminals of a piezoelectric element using a coil having the characteristics of curve 12 as shown in FIG. 7*a*, FIG. 4 and FIG. 5 respectively are a sectional view and a plan view of the nodal circle of the vibrator, FIG. 6 is a graph showing the characteristics between the frequency and the impedance of the vibrator, FIGS. 7*a*, 7*b* and 7*c* are graphs showing characteristics between the alternating voltage and the inductance L, FIG. 8*a* shows a sectional view of one type coil employed in this invention, the FIG. 8*b* shows another embodiment of the type coil employed in the invention.

DETAILED DESCRIPTION OF THE INVENTION

Referring now to FIG. 1, an acoustic piezoelectric vibrator comprises a circular piezoelectric element 2 attached to a circular metal plate 1. The peripheral portion of the metal plate 1 is fixed by the supporting means 3 and lead wires 4 are attached to the plate 1 and element 2 for connection to the other circuitry.

FIG. 2 shows an electric circuit embodying the invention. The reference numeral 9 denotes the acoustic vibrator shown in FIG. 1.

Describing the operation of the electric circuit, electric oscillation is developed in the closed loop composed of a coil 8 and the acoustic vibrator renders positive feedback to the base lead of a transistor 7 through a capacitor 6 so that the electric circuit maintains oscillation. Therefore, the mechanical vibration of the vibrator 9 is converted to an audible sound. The resistor 5 provides an appropriate bias to transistor 7 and a battery 10 supplies the needed electric power.

The oscillating frequency $fo$ of the circuit in FIG. 2 is expressed by the following relation:

$$fo = \frac{1}{2\pi\sqrt{LC}}$$

, where L is the inductance of the coil and C is the capacitance of the vibrator 9 operating as a capacitor.

Now, by selecting appropriately the magnetic coupling efficiency between the primary and the secondary of the coil 8, it is possible to make the output voltage of the vibrator 9 including the piezoelectric element 2 to vary with time and accordingly be amplitude modulated.

Accordingly, by using a coil having the characteristics indicated by curve 11 in FIG. 7*a*, i.e., one whose inductance L does not vary as a function of the alternating voltage $V_p$, as the coil 8, the wave shape of the voltage across the vibrator 9 including the piezoelectric element 2 is as shown in FIG. 3*a*.

On the other hand, using a coil having the characteristics indicated by 12 in FIG. 7*a*, i.e., one whose inductance L increases as a function of the alternating voltage $V_p$, as coil 8, the sound produced by the mechanical oscillation of the acoustic vibrator 9 including the piezoelectric element 2 is unique and the wave shape of the voltage across the vibrator 9 as is shown in FIG. 3*e*.

The magnetic loop of the coil whose inductance L varies as indicated by curve 12 is composed of silicon steel, permalloy and etc. which have high permeability and high electric conductivity.

Also, as understood from the electric circuit, the voltage applied to the piezoelectric element 2 is boosted by the coil 8 and to about 7 – 8 times the voltage of the power source so that the circuit does not need a high voltage-power source for operating the piezoelectric element 2.

Accordingly, the acoustic vibrator is able to provide the desired audible sound using a dry cell of 1.5V.

The coil having the characteristics of curve 12 in FIG. 7*a* and the curve shown in the graph in FIG. 7*b* is fabricated as an air-core coil as shown in FIG. 8*a*, or a magnetic-core coil which utilizes magnetic material for the core as shown in FIG. 8*b*.

In FIG. 8*a* and 8*b*, the reference numeral 13 depicts the bobbin and the reference numeral 14 depicts the winding wire of the coil. Also, the reference numeral 15 denotes the magnetic core.

The acoustic vibrator produces a stable sound in order to have a stable period of oscillation. Now, selecting $Q_2 > Q_1$, where $Q_1$ is the value of the quality factor Q of the closed loop composed of the vibrator 9 and the coil 8 when the vibrator is not vibrating, and $Q_2$ is the value of the quality factor Q of the vibrator, it is well-known as the drawing effect that the inductance L has a certain range of resonant frequencies $fo \approx fn$ since the capacitance of the vibrator varies so much at the proximity of the resonant point.

Selecting the inductance L at a value over the above range, the electric circuit oscillates at one-integer such as ½, ⅓ resonant frequency *fn*.

FIG. 3*b* is the wave shape of the voltage across the vibrator.

The wave shape of the voltage shown in FIG. 3*b* includes the component of 2 times the frequency *fo* since the vibrator vibrates at frequency *fn*. FIG. 3*c* is the wave shape of the collector current of transistor 7 and it shows that the driving frequency of the acoustic vibrator is *fo*.

FIG. 3*d* is the wave shape of the acoustic wave which includes frequency (=½.*fn*) except frequency *fo*.

In such a construction, it is possible to provide the vibrator in small size since the acoustic wave includes the frequency *fo* as an audible frequency as if the frequency *fn* is high.

Also, since the frequency components of *fn* and *fo* are related to the harmonics, persons can hear the buzzing sound comfortably.

The resonance of the fundamental mode depicted in FIG. 6 is that mode whose nodal point of vibration is located only at the peripheral fixed portion of the vibrator and the anti-nodal portion is located at the central portion of the vibrator, as wellknown.

The resonant frequency of the circular plate 1 (metal plate) includes the fundumental mode and the high harmonic resonant frequency.

There is great removal of system in the vibration of the fundamental mode, since metal plate and piezoelectric element have mass, so that the quality factor Q comes to a low value because of the gravity effect.

However, at the high harmonic resonant point, the quality factor Q comes to a high value since there is very little removal of the effects of gravity of the vibrator.

According to experiment, the value of the quality factor Q when the vibrator has one nodal point is 100 whereas the value of the quality factor Q falls below 10.

There is great removal of system in the adapt to produce the buzzing sound as the sounding source of electronic buzzer since it has the frequency of 1 – 3 KHZ.

What I claim is:

1. An electronic buzzer comprising: an acoustic vibrator comprised of a vibratable metal plate, means fixedly supporting said metal plate around its periphery to undergo vibration relative to its fixed periphery, and a piezoelectric element adhered to one face of said metal plate; and driving means for applying electric driving signals to said acoustic vibrator to vibrationally drive the same at a 1/N multiple of its natural frequency, where N is an integer, to thereby cause said acoustic vibrator to emit an audible buzzing sound.

2. An electronic buzzer according to claim 1; wherein said metal plate has a circular shape and is fixedly supported around its circumferential periphery.

3. An electronic buzzer according to claim 2; wherein said driving means includes a closed loop circuit comprised of a capacitor and an inductor, and wherein said capacitor includes said acoustic vibrator with said piezoelectric element comprising the capacitor dielectric.

4. An electronic buzzer according to claim 3; wherein said driving means includes means for applying electric driving signals of selectively variable frequency to accordingly vary the inductance of said inductor to thereby vary the period of oscillation of said acoustic vibrator and the resultant frequency of the buzzing sound.

5. An electronic buzzer according to claim 4; wherein said inductor comprises a coil having an air core.

6. An electronic buzzer according to claim 4; wherein said inductor comprises a coil having a magnetic core.

7. An electronic buzzer comprising: an acoustic vibrator comprised of a vibratable metal plate of circular shape, means fixedly supporting said metal plate around its circumferential periphery to undergo vibration relative to its fixed periphery in a natural vibration mode having one nodal circle, and a piezoelectric element adhered to one face of said metal plate; and driving means for applying electric driving signals to said acoustic vibrator to vibrationally drive the same at a 1/N multiple of its natural frequency, where N is an integer, to thereby cause said acoustic vibrator to emit an audible buzzing sound.

8. An electronic buzzer according to claim 7; wherein said driving means includes a closed loop circuit comprised of a capacitor and an inductor, and wherein said capacitor includes said acoustic vibrator with said piezoelectric element comprising the capacitor dielectric.

9. An electronic buzzer according to claim 8; wherein said driving means includes means for applying electric driving signals of selectively variable frequency to accordingly vary the inductance of said inductor to thereby vary the period of oscillation of said acoustic vibrator and the resultant frequency of the buzzing sound.

10. An electronic buzzer according to claim 9; wherein said inductor comprises a coil having an air core.

11. An electronic buzzer according to claim 9; wherein said inductor comprises a coil having a magnetic core.

* * * * *